US012508462B1

(12) United States Patent
Yu

(10) Patent No.: US 12,508,462 B1
(45) Date of Patent: Dec. 30, 2025

(54) ADJUSTABLE KETTLEBELL AND KETTLEBELL KIT

(71) Applicant: Zhejiang Zuojian Industry and Trade Co., Ltd., Jinhua (CN)

(72) Inventor: Zhaohong Yu, Yongkang (CN)

(73) Assignee: Zhejiang Zuojian Industry and Trade Co., Ltd, Jinhua (CN)

( * ) Notice: Subject to any disclaimer, the term of this patent is extended or adjusted under 35 U.S.C. 154(b) by 0 days.

(21) Appl. No.: 19/254,148

(22) Filed: Jun. 30, 2025

(30) Foreign Application Priority Data

Aug. 14, 2024 (CN) ..... 202421981369.0

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0726; A63B 21/0728; A63B 21/072–075
See application file for complete search history.

(56) References Cited

U.S. PATENT DOCUMENTS 7,762,933 B1 * 7/2010 Yu ..... A63B 21/075 482/109
10,099,083 B1 * 10/2018 Owusu ..... A63B 24/0062
2018/0117387 A1 * 5/2018 Wang ..... A63B 21/072
2021/0023411 A1 * 1/2021 Wang ..... A63B 21/075
2025/0281788 A1 * 9/2025 Wang ..... A63B 21/4035

FOREIGN PATENT DOCUMENTS

CN 218516050 U * 2/2023

OTHER PUBLICATIONS

Translation of CN-218516050-U (Year: 2023).*

* cited by examiner

*Primary Examiner* — Megan Anderson
*Assistant Examiner* — Catrina A Letterman
(74) *Attorney, Agent, or Firm* — JEEN IP LAW, LLC

(57) ABSTRACT

An adjustable kettlebell and a kettlebell kit are provided, the adjustable kettlebell includes a kettlebell shell; one or more kettlebell pieces, each of the kettlebell pieces is provided with an adjustment component; when the adjustment component is connected to the kettlebell shell, the corresponding kettlebell piece of the adjustment component is provided on the kettlebell shell; and a driving mechanism provided on the kettlebell shell, and the driving mechanism includes a driving component configured to drive any number of adjustment components to connect to the kettlebell shell. This application has the effect of enabling users to meet the needs of different exercise intensities by purchasing only one kettlebell.

10 Claims, 19 Drawing Sheets

ADJUSTABLE KETTLEBELL AND KETTLEBELL KIT

CROSS-REFERENCE TO RELATED APPLICATIONS

This application claims priority to Chinese Patent Application No. 202421981369.0, filed on Aug. 14, 2024, which is hereby incorporated by reference in its entirety.

TECHNICAL FIELD

The present disclosure relates to the field of kettlebell technologies, and in particular, to an adjustable kettlebell and a kettlebell kit.

BACKGROUND

Kettlebells are auxiliary equipment for fitness exercises, they are popular among fitness enthusiasts due to their small space occupation and convenient use. When users use kettlebells for exercise, they often need to replace kettlebells of different weights to meet the needs of different exercise intensities.

However, traditional kettlebells are mostly of fixed weight. As exercise intensity increases, it is necessary to purchase a plurality of kettlebells of different weights to meet the needs of different exercise intensities. This will increase economic investment and also occupy a larger space for placement or storage, which is extremely inconvenient.

SUMMARY

In order to enable users to meet needs of different exercise intensities by purchasing only one kettlebell, this application provides an adjustable kettlebell and a kettlebell kit.

The adjustable kettlebell and kettlebell kit provided in this application adopt the following technical solution.

An adjustable kettlebell, including:

a kettlebell shell;

one or more kettlebell pieces, each of the one or more kettlebell pieces is provided with an adjustment component; when the adjustment component is connected to the kettlebell shell, the corresponding kettlebell piece of the adjustment component is provided on the kettlebell shell; and a driving mechanism, the driving mechanism is provided on the kettlebell shell, the driving mechanism includes a driving component, and the driving component is configured to drive any number of the adjustment components to connect to the kettlebell shell.

By adopting the above technical solution, when users need kettlebells of different weights to meet needs of different exercise intensities, they drive the driving component, so that the driving component drives the number of adjustment components corresponding to the weight of the kettlebell required by the user, and all the required number of adjustment components are connected to the kettlebell shell, so that the corresponding number of kettlebell pieces are installed on the kettlebell shell, thereby adjusting the weight of the kettlebell to the weight required by the user, so that users only need to purchase one kettlebell to meet the needs of different exercise intensities. This improves the traditional kettlebells, which are mostly fixed in weight. With the increase of exercise intensity, a plurality of kettlebells of different weights need to be purchased to meet the needs of different exercise intensities, which will increase economic investment, and it will also occupy a larger space for placement or storage, which is extremely inconvenient.

In one embodiment of the present disclosure, the adjustment component includes one or more adjustment pin bodies, each of the one or more adjustment pin bodies are slid radially to fit on the kettlebell piece; when the adjustment component is connected to the kettlebell shell, each of the adjustment pin bodies is threaded through the kettlebell shell so that the kettlebell piece is provided on the kettlebell shell.

In one embodiment of the present disclosure, the driving component includes a driving shaft, the driving shaft is provided on the kettlebell shell, an axis of the driving shaft is coaxial with a central axis; the driving shaft is rotated around the central axis; the driving shaft is sequentially threaded through each of the kettlebell pieces from close to the kettlebell shell towards away from the kettlebell shell;

the driving shaft is fixedly provided with one or more sets of driving protrusions, and the number of each set of driving protrusions includes one or more; each set of driving protrusions corresponds to each of the kettlebell pieces; when the driving shaft is rotated, any number of driving protrusions pushes the corresponding number of adjustment pin bodies through the kettlebell shell.

In one embodiment of the present disclosure, a curvature of each driving protrusion is gradually decreased from a direction close to the kettlebell shell towards a direction away from the kettlebell shell, so that the driving shaft sequentially drives each adjustment component from a direction close to the kettlebell shell towards a direction away from the kettlebell shell.

In one embodiment of the present disclosure, the driving component further includes a driving cover, and the driving cover is coaxially fixed to the driving shaft, and the driving cover is rotated to drive the driving shaft to rotate.

In one embodiment of the present disclosure, the driving cover is provided with a plurality of locking slots, and the locking slots are distributed around an axis of the driving cover in a circumferential direction; the kettlebell shell is fixedly provided with a plurality of locking protrusions, and when each locking protrusion passes through each locking slot, a rotation of the driving cover is blocked by each locking protrusion, so that each kettlebell piece is stably provided on the kettlebell shell.

In one embodiment of the present disclosure, the driving component further includes a locking spring, one end of the locking spring abuts against the driving shaft, and the other end of the locking spring abuts against the kettlebell shell.

In one embodiment of the present disclosure, the driving mechanism further includes one or more sets of shifting components, each of the shifting components is provided on the driving cover and distributed circumferentially around the axis of the driving shaft;

the shifting component includes a shifting protrusion and a shifting spring; the shifting protrusion slides radially and fitted with the driving cover; the kettlebell shell is provided with a plurality of shifting slots, and the shifting protrusion penetrates any shifting slot; one end of the shifting spring is connected to the driving cover, and the other end of the shifting spring is connected to the shifting protrusion.

In one embodiment of the present disclosure, the adjustment component further includes an adjustment spring, one end of the adjustment spring abuts against the adjustment pin body, and the other end of the adjustment spring abuts against the kettlebell piece.

A kettlebell kit, including an adjustable kettlebell and a kettlebell seat configured to place the adjustable kettlebell; the kettlebell seat is provided with a placement slot configured to place the adjustable kettlebell, and the placement slot is fixedly provided with an unlocking convex platform; when the adjustable kettlebell is placed in the placement slot, the unlocking convex platform abuts against the driving shaft and pushes the driving shaft to slide in a direction close to the kettlebell shell.

In summary, the present application includes at least one beneficial technical effect as follows.

When users need kettlebells of different weights to meet the needs of different exercise intensities, they drive the driving component, so that the driving component drives the number of adjustment components corresponding to the weight of the kettlebells required by the user, and all the required number of adjustment components are connected to the kettlebell shell, so that the corresponding number of kettlebell pieces are provided on the kettlebell shell, thereby adjusting the weight of the kettlebells to the weight required by the user, so that users only need to purchase one kettlebell to meet the needs of different exercise intensities, improving the traditional kettlebells that are mostly fixed in weight. With the increase of exercise intensity, a plurality of kettlebells of different weights need to be purchased to meet the needs of different exercise intensities, which will increase economic investment and also occupy a larger space for placement or storage, an extremely inconvenient issue.

Numeral reference: 1—kettlebell shell; 11—inner shell; 12—outer shell; 121—driving hole; 122—connection hole; 123—locking protrusion; 124—shifting slot; 13—installation casing; 131—connection pin hole; 14—handle; 2—kettlebell piece; 21—central axis hole; 22—connection recess; 23—connection protrusion; 24—rotating plate; 241—rotating hole; 25—adjustment component; 251—adjustment pin seat; 252—adjustment pin body; 253—adjustment spring; 26—pin slot; 3—driving mechanism; 31—driving component; 311—driving shaft; 3111—driving convex block; 312—driving cover; 3121—locking slot; 3122—weight observation port; 313—locking spring; 32—shifting component; 321—shifting protrusion; 322—shifting spring; 10—adjustable kettlebell; 20—kettlebell seat; 201—placement slot; 2011—unlocking convex platform.

DESCRIPTION OF EMBODIMENTS

Further detailed explanation of the present application will be provided in combination with FIGS. 1-19.

Figure 1:
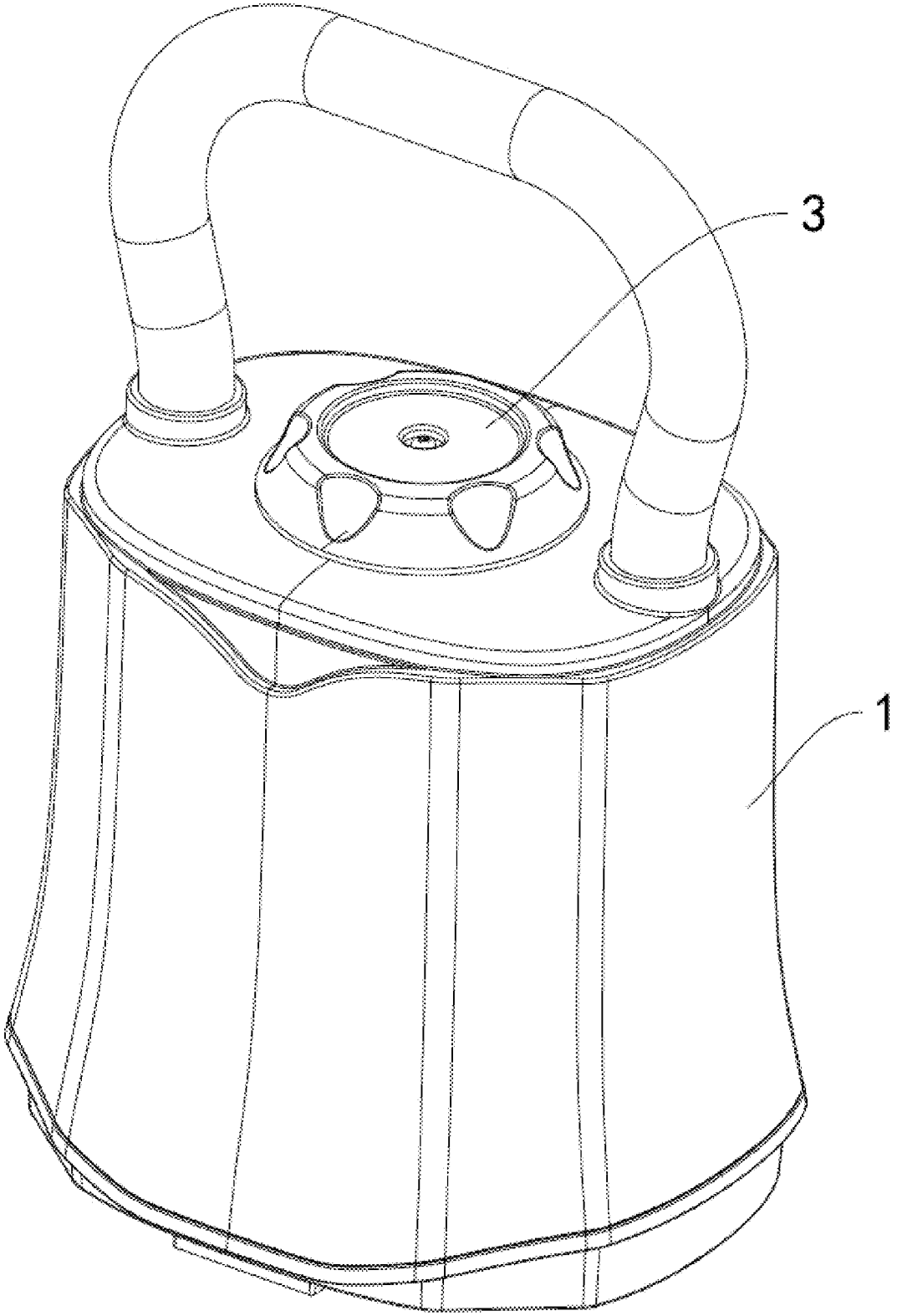
FIG. 1 is a first schematic diagram of an overall structure of an adjustable kettlebell.
Figure 2:
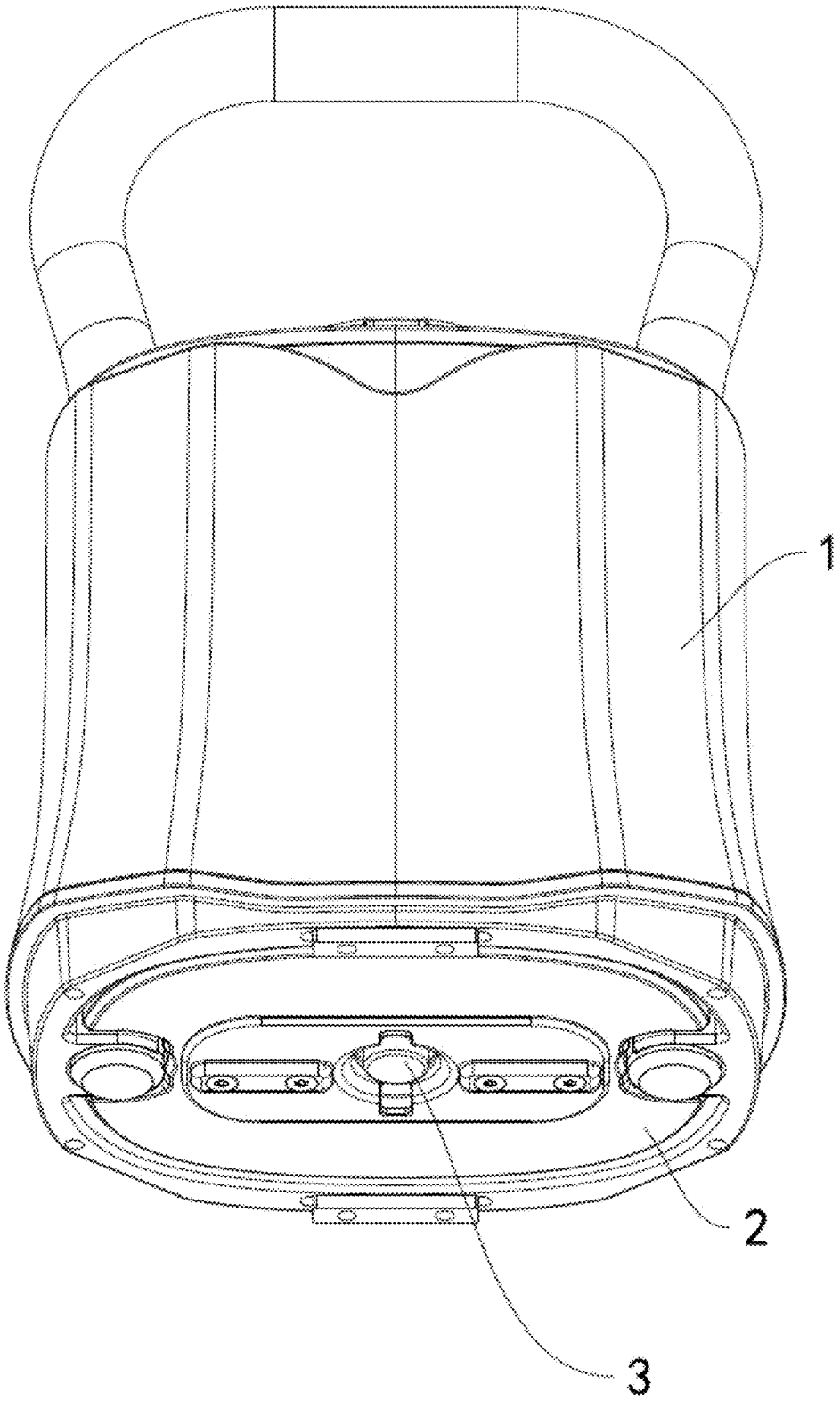
FIG. 2 is a second schematic diagram of the overall structure of the adjustable kettlebell.
Figure 3:
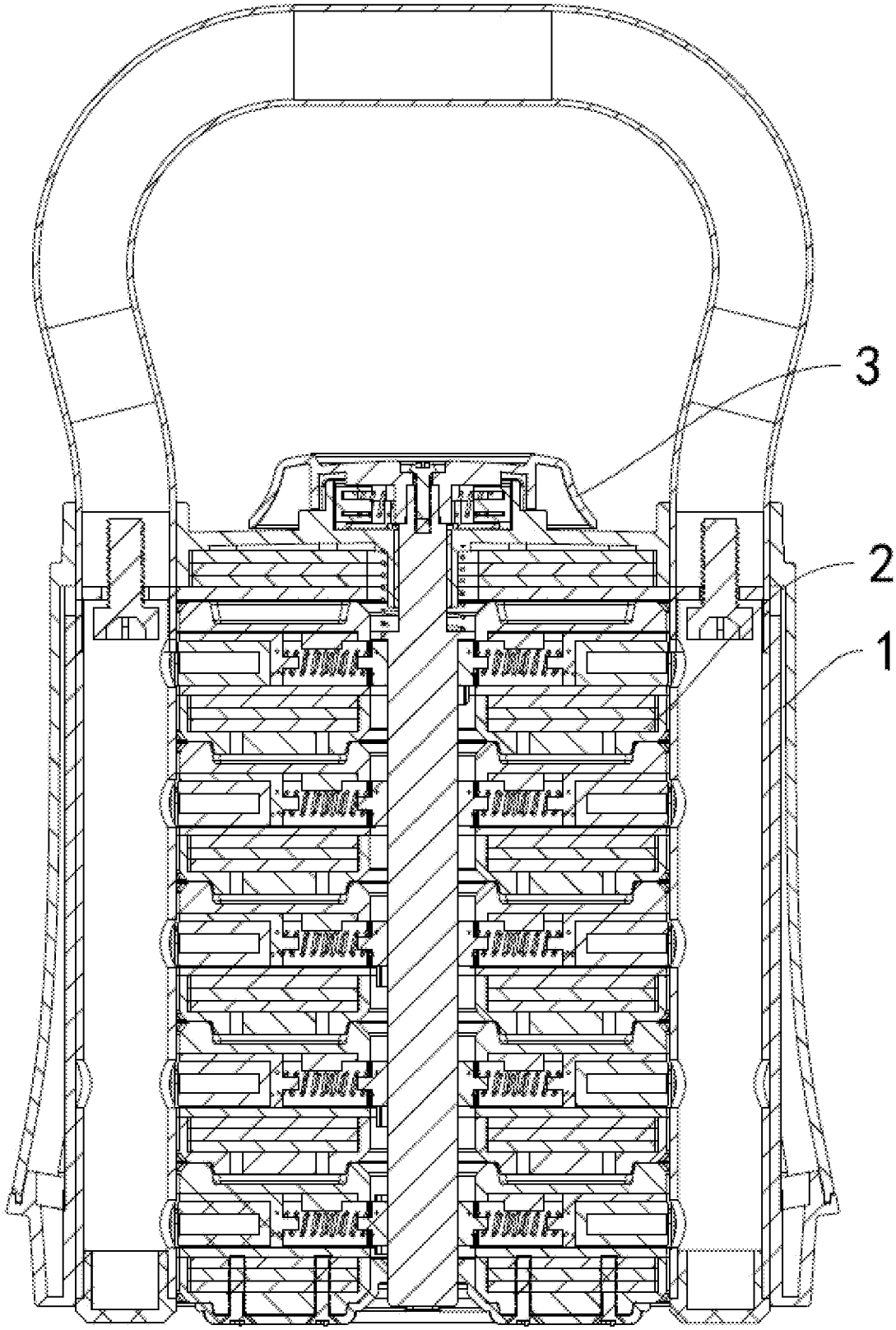
FIG. 3 is a sectional view of the overall structure of the adjustable kettlebell.

This application discloses an adjustable kettlebell and a kettlebell kit. Referring to FIGS. 1 to 3, the adjustable kettlebell includes a kettlebell shell 1, a plurality of kettlebell pieces 2, and a driving mechanism 3. Each of the kettlebell pieces 2 is provided on the kettlebell shell 1, and the driving mechanism 3 is provided on the kettlebell shell 1.

Figure 4:
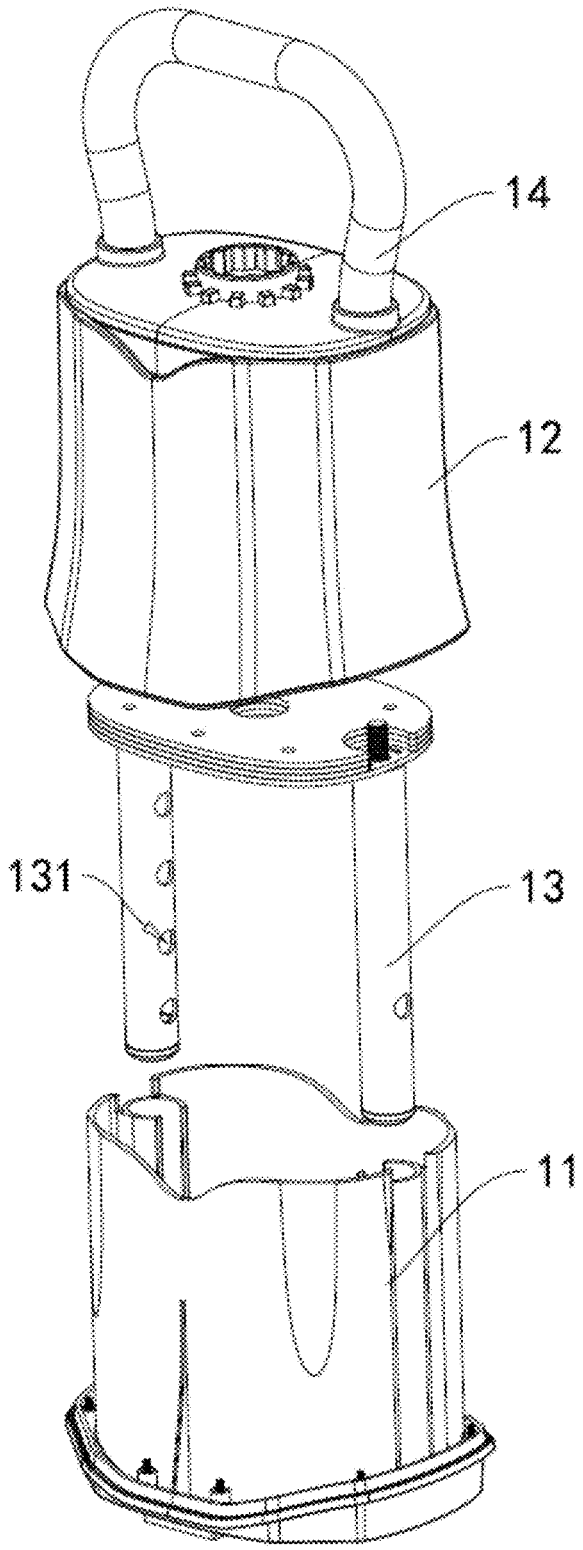
FIG. 4 is an exploded view of a kettlebell shell for the adjustable kettlebell.
Figure 5:
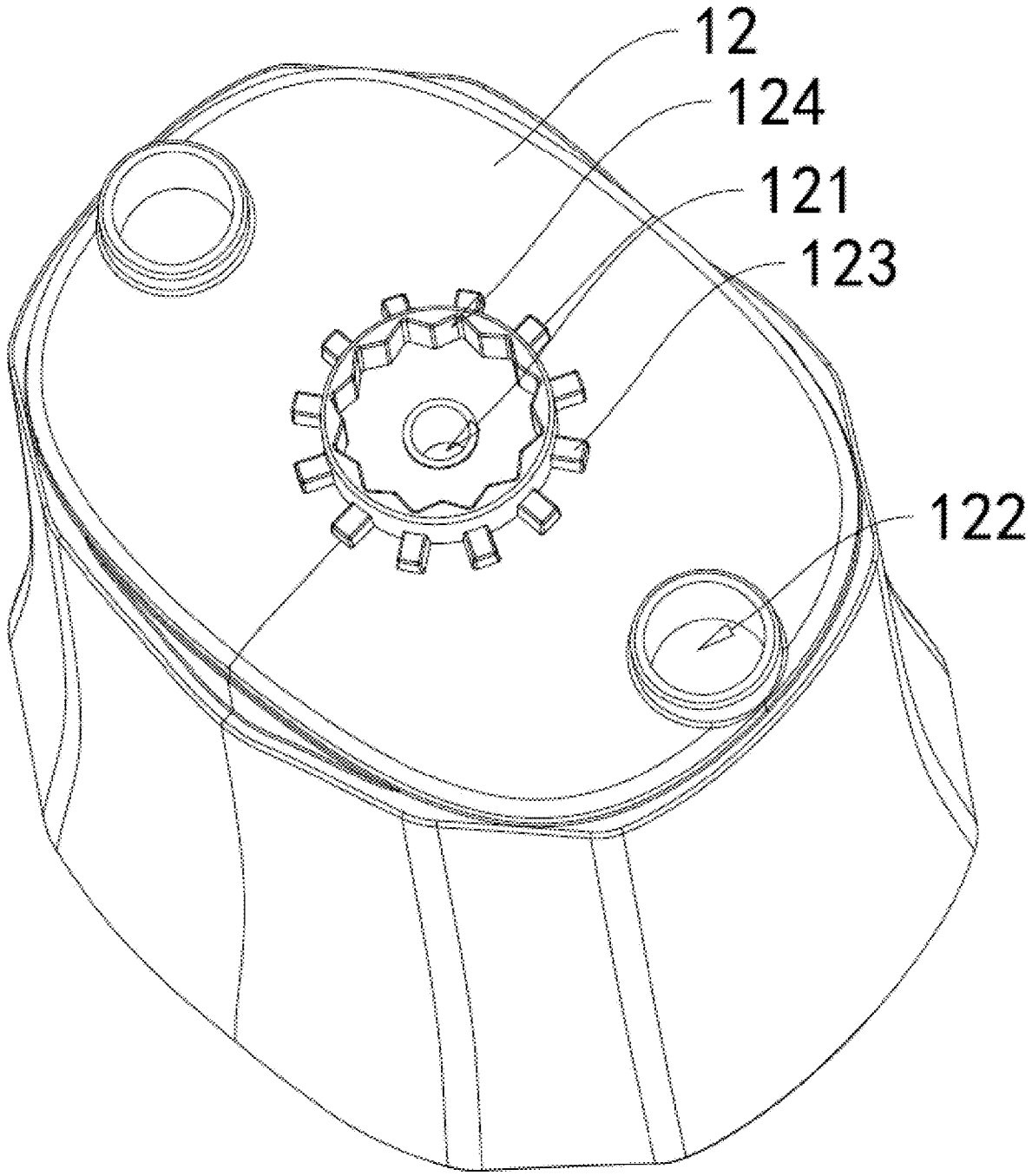
FIG. 5 is a schematic structural diagram of an outer shell of the adjustable kettlebell.

Referring to FIGS. 4 and 5, the kettlebell shell 1 includes an inner shell 11, an outer shell 12, two installation casings 13, and a handle 14. The outer shell 12 is sleeved on the inner shell 11 and fixedly connected to the inner shell 11. A counterweight is fixedly provided between the inner shell 11 and the outer shell 12. A driving hole 121 is provided at a center position of the outer shell 12, an axis of the driving hole 121 is provided as a central axis. A radial direction of the driving hole 121 is provided as a radial direction. Two installation casings 13 are fixedly provided on two sides of the inner shell 11, and the two installation casings 13 are directly facing each other. Both the two installation casings 13 are provided with a plurality of connection pin holes 131, and the connection pin holes 131 are evenly distributed along a length direction of the installation casings 13. The outer shell 12 is provided with two connection holes 122 that run through it, and two ends of the handle 14 are respectively threaded through the two connection holes 122 and fixedly connected to the two installation casings 13.

Referring to FIGS. 6 to 9, when each of the kettlebell pieces 2 is provided on the kettlebell shell 1, each of the kettlebell pieces 2 is located inside the inner shell 11, and the central axis hole 21 is provided in a middle position of each of the kettlebell pieces 2. The axis of the central axis hole 21 is coaxial with the central axis, and two connection recess 22 are provided on one side of each of the kettlebell pieces 2. The two connection recesses 22 are evenly distributed around an axis of the central axis hole 21 in a circumferential direction. On the other side of each of the kettlebell pieces 2, two connection protrusions 23 are fixedly arranged, and the two connection protrusions 23 are evenly distributed around the axis of the central axis hole 21 in the circumferential direction. When each of the kettlebell pieces 2 is provided on the kettlebell shell 1, the two connecting protrusions of one kettlebell piece 2 in each adjacent kettlebell piece 2 of the connection protrusion 23 are respectively passes through the two connection recess 22 of another kettlebell piece 2 to render a connection between each of the kettlebell piece 2 more stable. One kettlebell piece 2 is fixedly provided with a rotating plate 24, the rotating plate 2 is provided with a rotating hole 241 penetrating through it.

Figure 6:
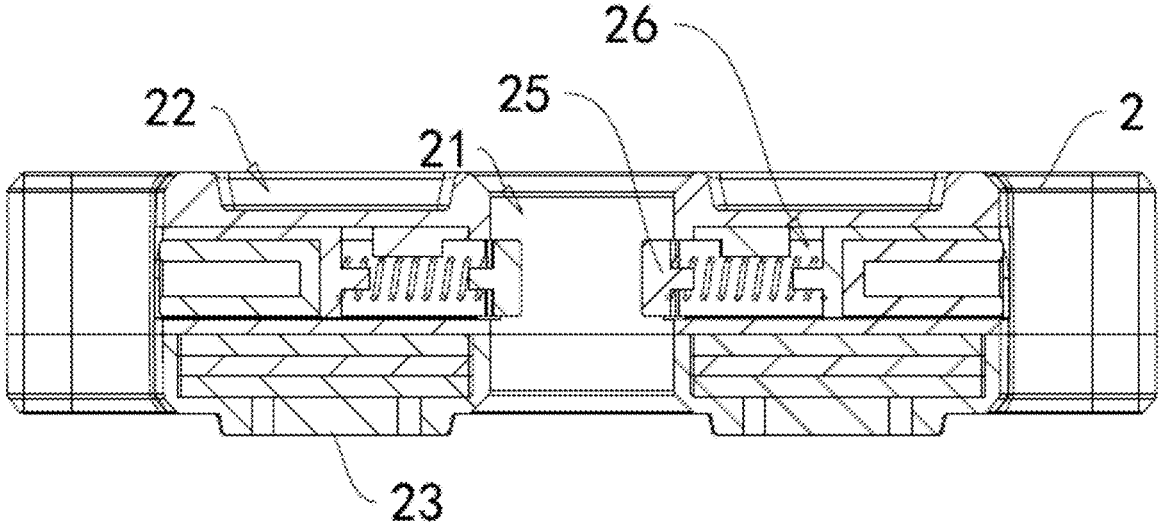
FIG. 6 is a sectional structural view of a kettlebell piece for the adjustable kettlebell.
Figure 7:
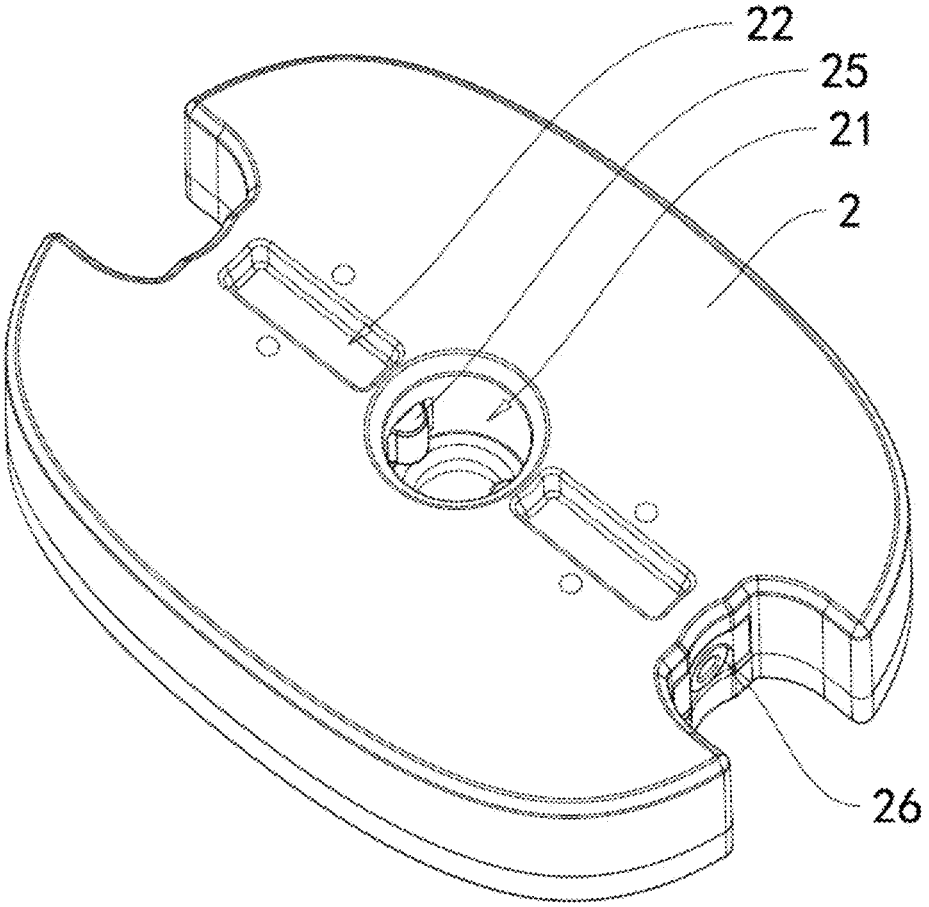
FIG. 7 is a first schematic structural diagram of the kettlebell piece for the adjustable kettlebell.
Figure 8:
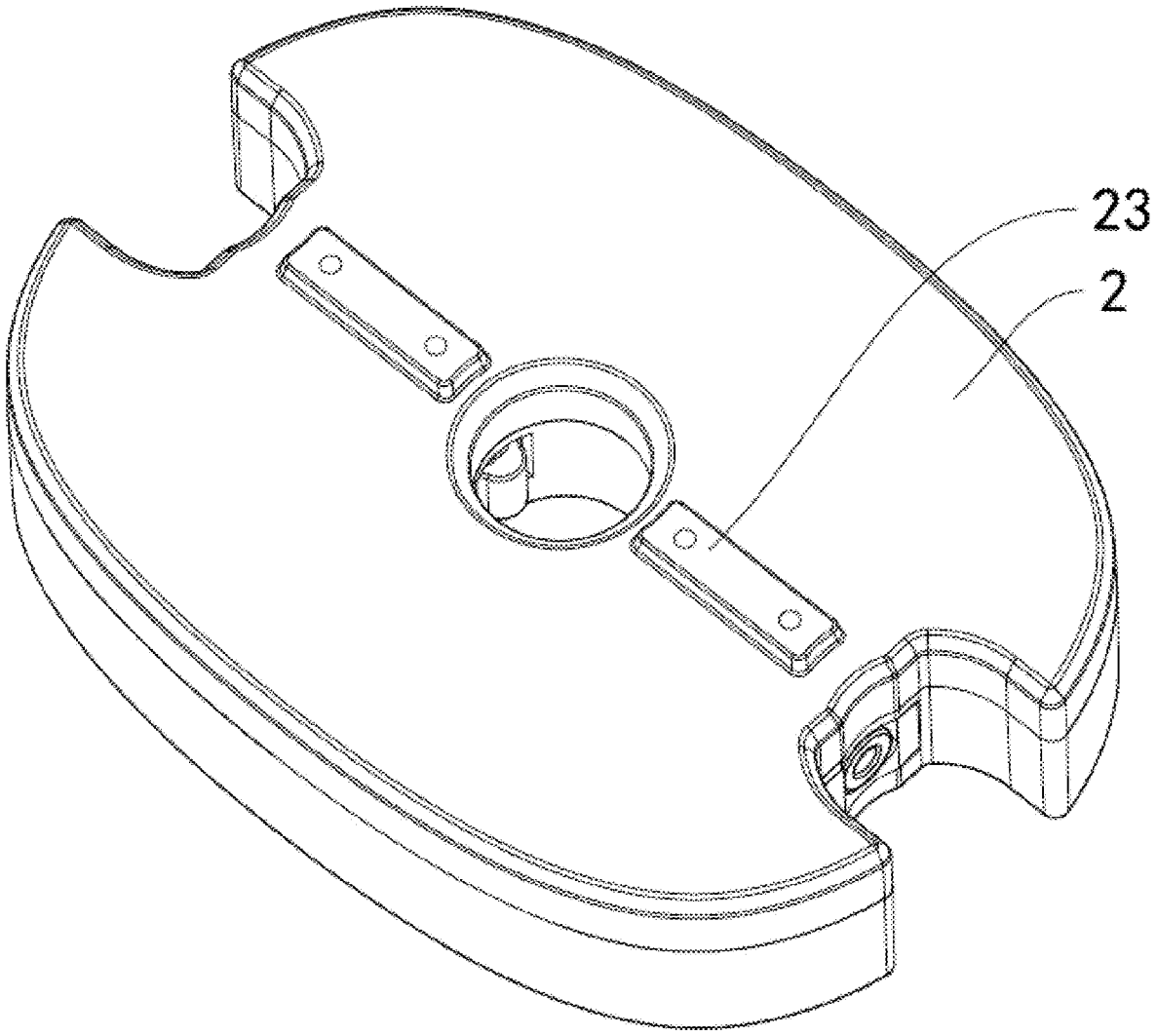
FIG. 8 is a second schematic structural diagram of the kettlebell piece for the adjustable kettlebell.
Figure 9:
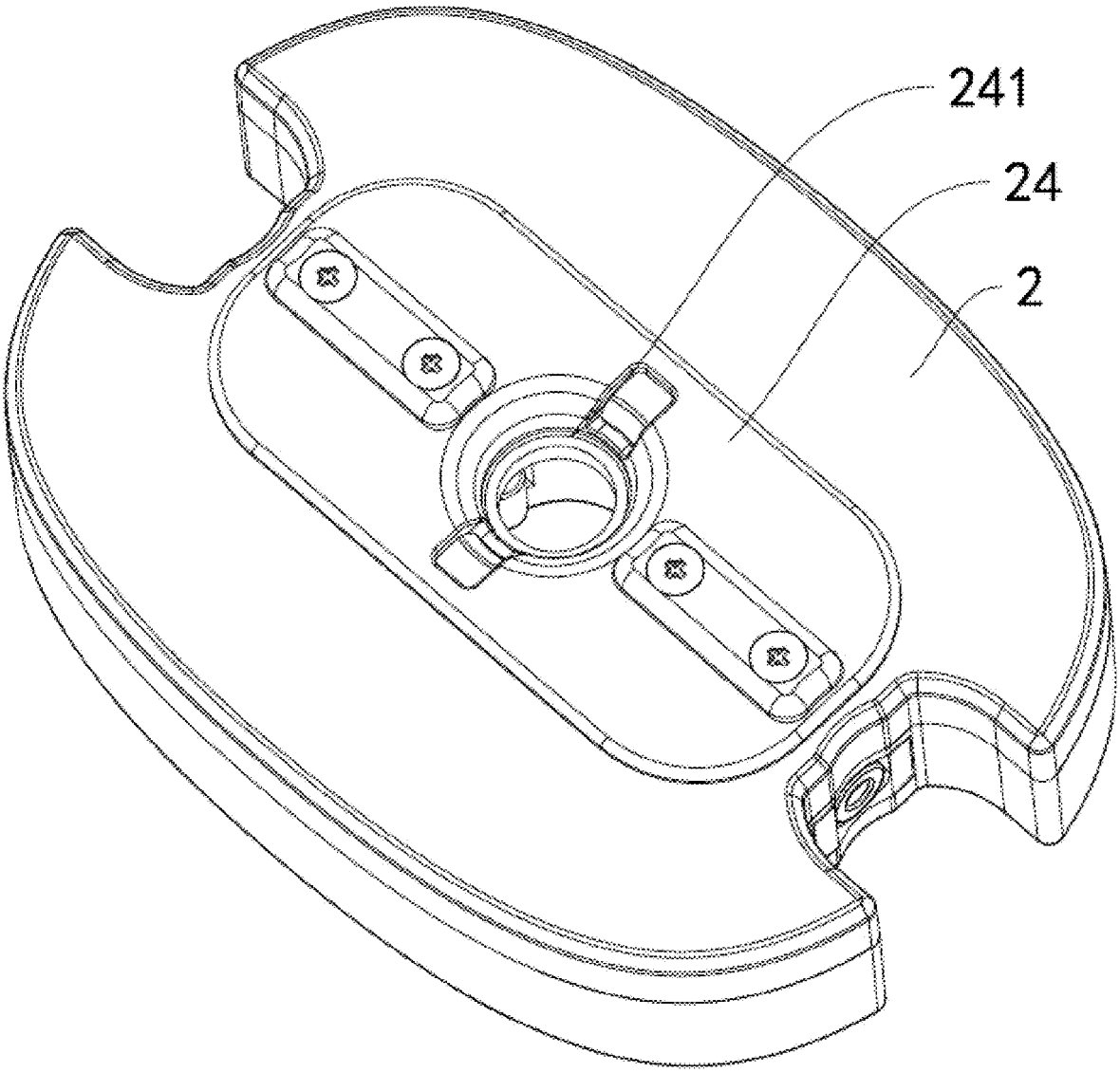
FIG. 9 is a schematic structural diagram of a rotating plate for the adjustable kettlebell.
Figure 10:
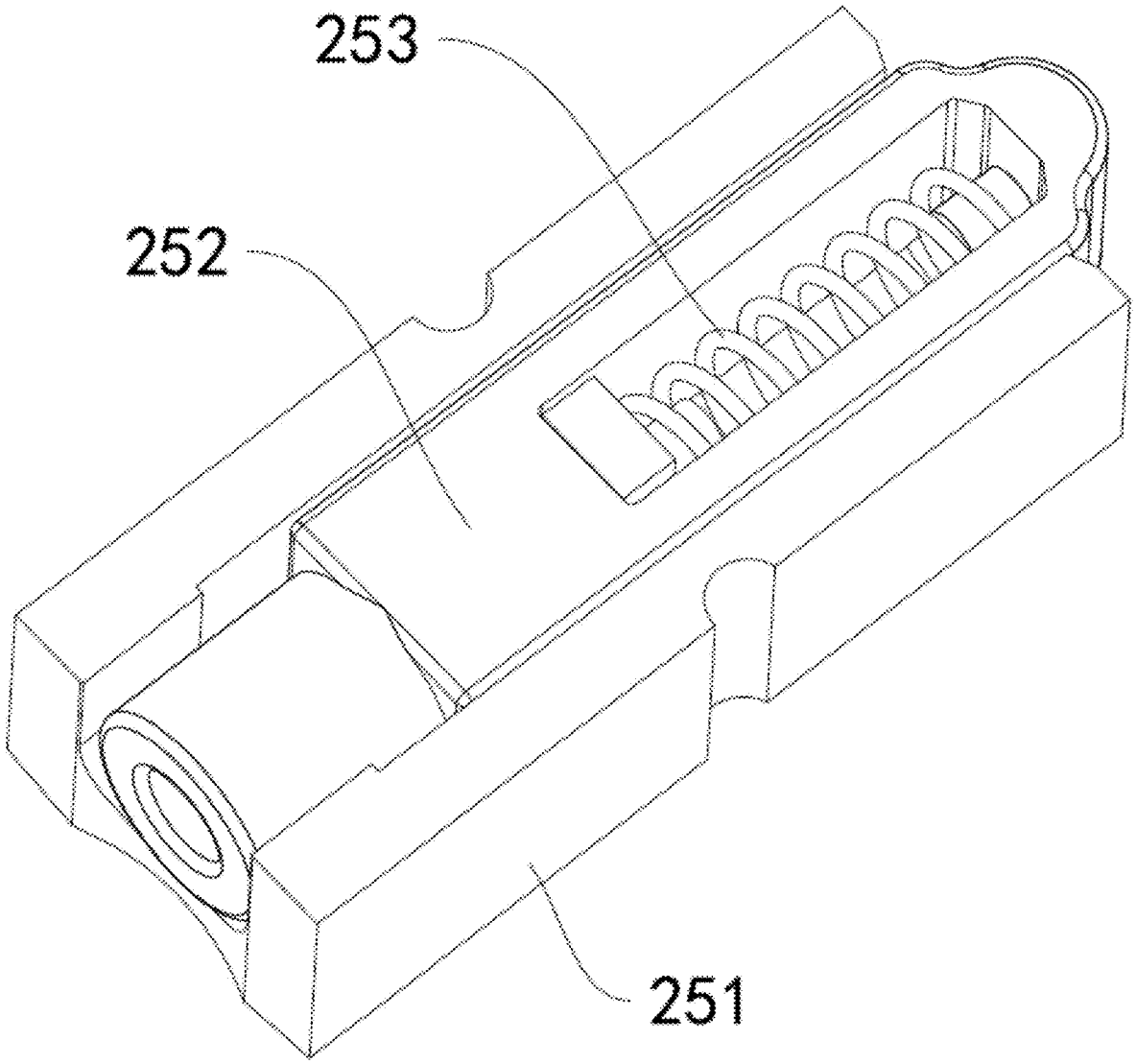
FIG. 10 is a schematic structural diagram of an adjustment component for the adjustable kettlebell.

Referring to FIGS. 6 and 10, the kettlebell piece 2 is provided with an adjustment component 25 inside. The adjustment component 25 includes two adjustment pin seats 251, two adjustment pin bodies 252, and two adjustment springs 253. The kettlebell piece 2 is provided with two pin slots 26 that run through it. The two pin slots 26 are arranged radially, and the two pin slots 26 are arranged facing each other and communicated to the central axis hole 21. The two adjustment pin seat 251 are respectively arranged and fixed in the two pin slots 26, and the two adjustment pin bodies 252 are respectively arranged and slidably fitted in the two pin slots 26. The adjustment spring 253 is located between the adjustment pin body 252 and the adjustment pin seat 251. One end of the two adjustment springs 253 is respectively abutted against the two adjustment pin bodies 252. The other end of the adjustment spring 253 is respectively abutted against the two adjustment pin seats 251. When the kettlebell piece 2 is provided on the kettlebell shell 1, the two adjustment pin body 252 are respectively threaded through the connection pin holes 131 of the two installation casings 13, so that the kettlebell piece 2 is provided on the kettlebell shell 1.

Figure 11:
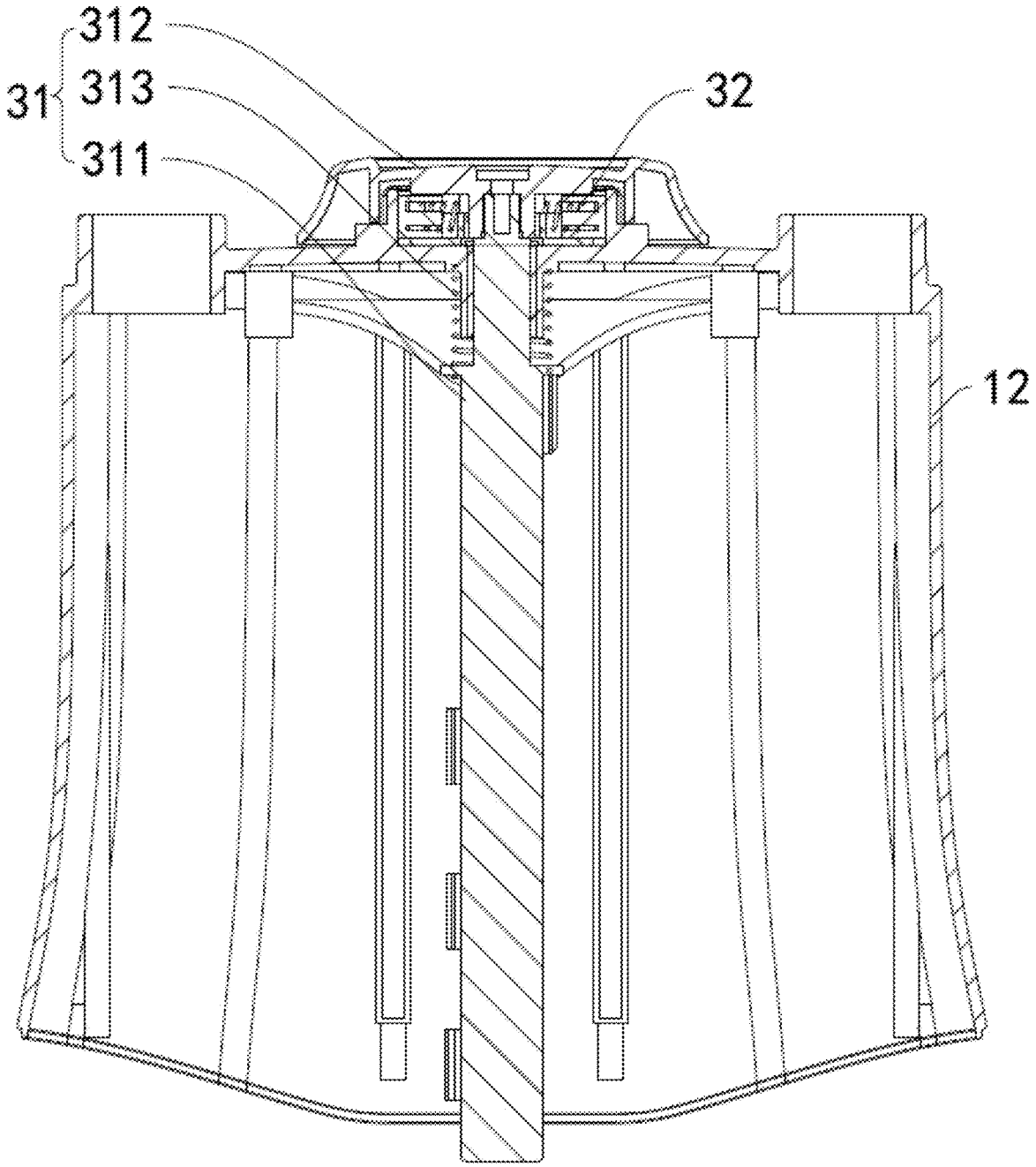
FIG. 11 is a sectional structural view of a driving mechanism for the adjustable kettlebell.
Figure 12:
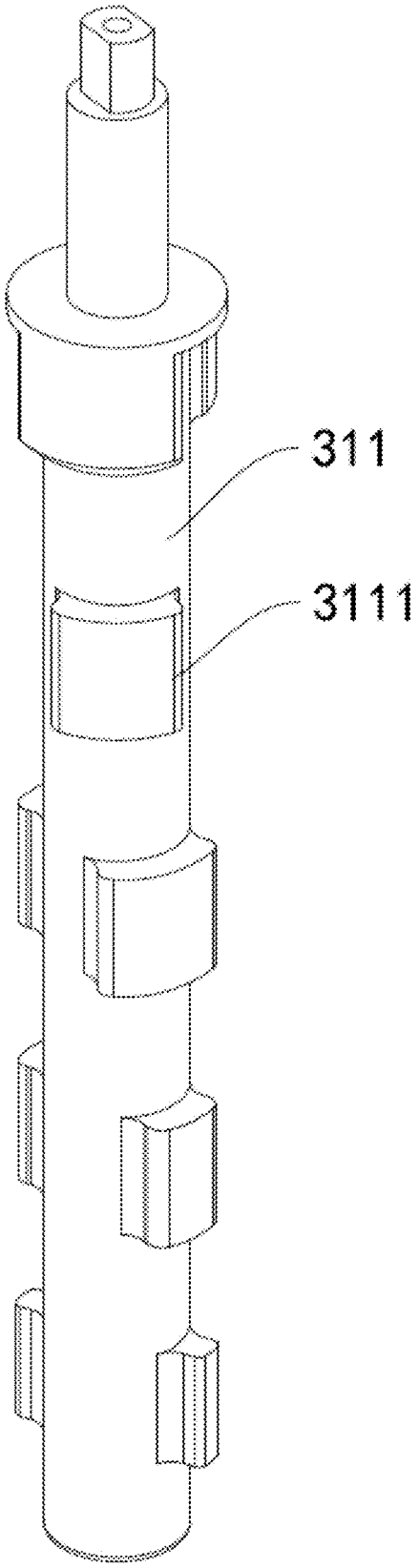
FIG. 12 is a schematic structural diagram of a driving rod for the adjustable kettlebell.

Referring to FIGS. 11 and 12, the driving mechanism 3 includes a driving component 31, the driving component 31 includes a driving shaft 311. The driving shaft 311 is threaded through the driving hole 121, and its axis of the driving shaft 311 is coaxial with the central axis. The driving shaft 311 can be rotated around the central axis and can slide along the central axis towards or away from the kettlebell shell 1. The driving shaft 311 is sequentially threaded through the central axis holes 21 of each of the kettlebell pieces 2 from close to the kettlebell shell 1 towards away from the kettlebell shell 1. The driving shaft 311 is threaded and rotated to fit with the rotating hole 241, thereby rendering a rotation of the driving shaft 311 around the central axis more stable.

Figure 13:
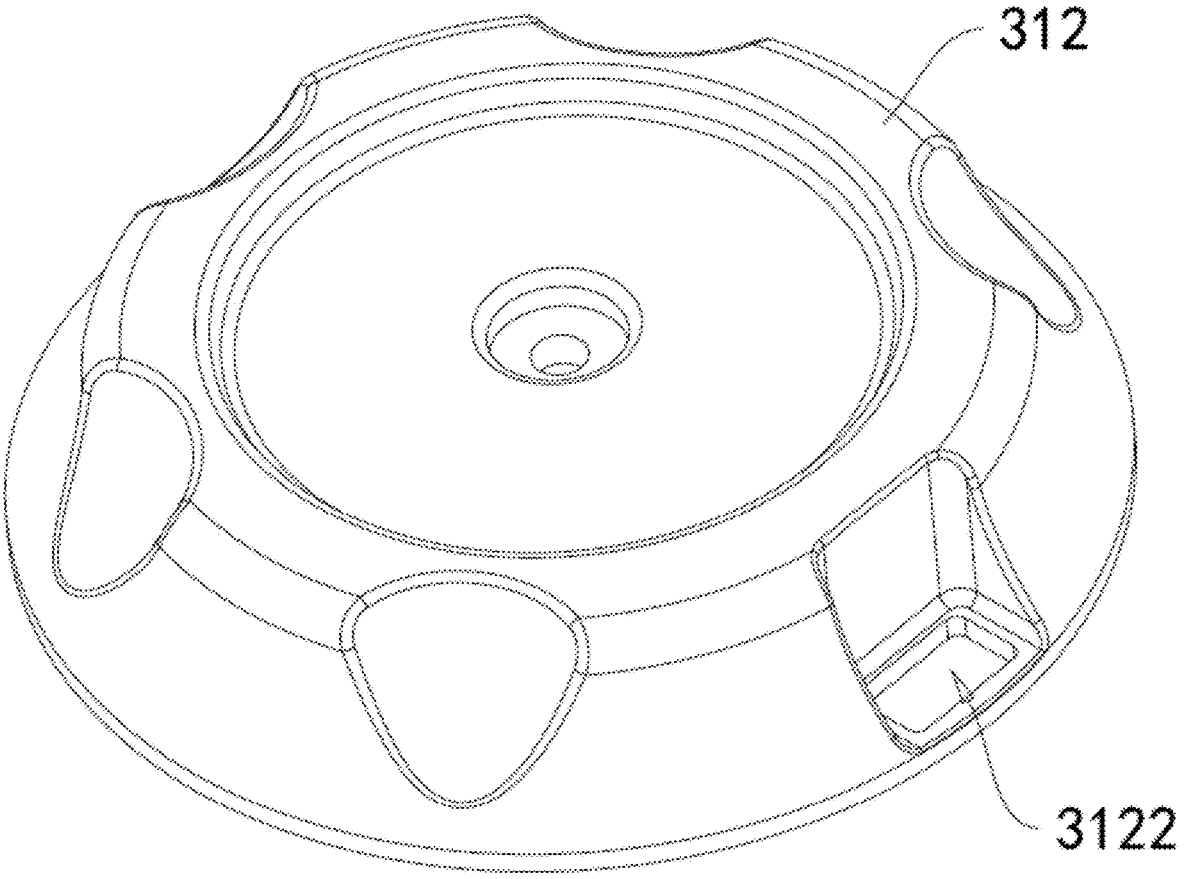
FIG. 13 is a first schematic structural diagram of a driving cover for the adjustable kettlebell.

Referring to FIG. 13, a plurality of sets of driving protrusions 3111 are fixedly arranged on an outer peripheral surface of the driving shaft 311. Each set of the driving protrusions 3111 is distributed along a length direction of the driving shaft 311. There are two in each set of driving protrusions 3111, and the two driving protrusions 3111 are arranged facing each other. Each set of driving protrusions 3111 corresponds to each of the kettlebell piece 2. A curvature of each of the driving protrusions 3111 is gradually decreased from a direction close to the kettlebell shell 1 to a direction away from the kettlebell shell 1, so that the driving shaft 311 drives each adjustment component 25 in sequence from a direction close to the kettlebell shell 1 to a direction away from the kettlebell shell 1, thereby allowing any number of kettlebell piece 2 to be installed in sequence from the direction close to the kettlebell shell 1 to the direction away from the kettlebell shell 1.

Figure 14:
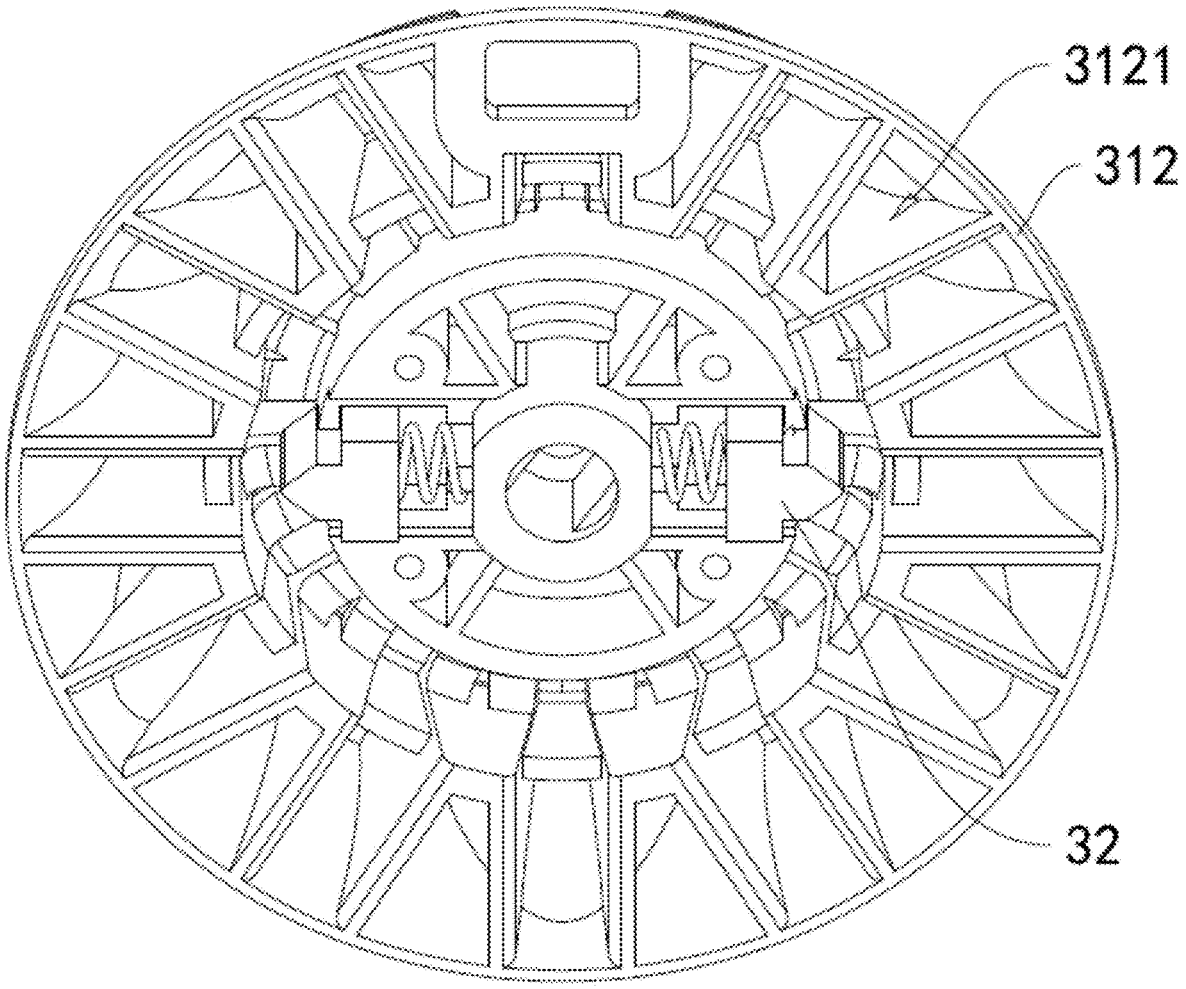
FIG. 14 is a second schematic structural diagram of the driving cover for the adjustable kettlebell.

Referring to FIGS. 11, 13, and 14, the driving component 31 further includes a driving cover 312 and a locking spring 313. The driving cover 312 is coaxially fixed to the driving shaft 311, and the driving cover 312 is rotated to drive the driving shaft 311 to rotate. The driving cover 312 is provided with a plurality of locking slots 3121, and the locking slots 3121 are evenly distributed around an axis of the driving cover 312. The outer shell 12 is fixedly provided with a plurality of locking protrusions 123, and when each of the locking protrusions 123 passes through each of the locking slots 3121, a rotation of the driving cover 312 is blocked by each of the locking protrusions 123, so that each of the kettlebell pieces 2 is stably provided on the kettlebell shell 1. The driving shaft 311 passes through the locking spring 313, and one end of the locking spring 313 abuts against the driving shaft 311. The other end of the locking spring 313 abuts against kettlebell shell 1, the providing the locking spring 313 renders the driving cover 312 can operate without external force, each of the locking protrusions 123 always remains be threaded through each of the locking slots 3121.

Referring to FIGS. 11, 13, and 14, the driving cover 312 is provided with a weight observation port 3122 that runs through it, and the outer shell 12 is engraved with a plurality of weight adjustment scales (not shown in the figure). The weight adjustment scale for the weight observation port 3122 is the weight of the kettlebell at this time.

Figure 15:
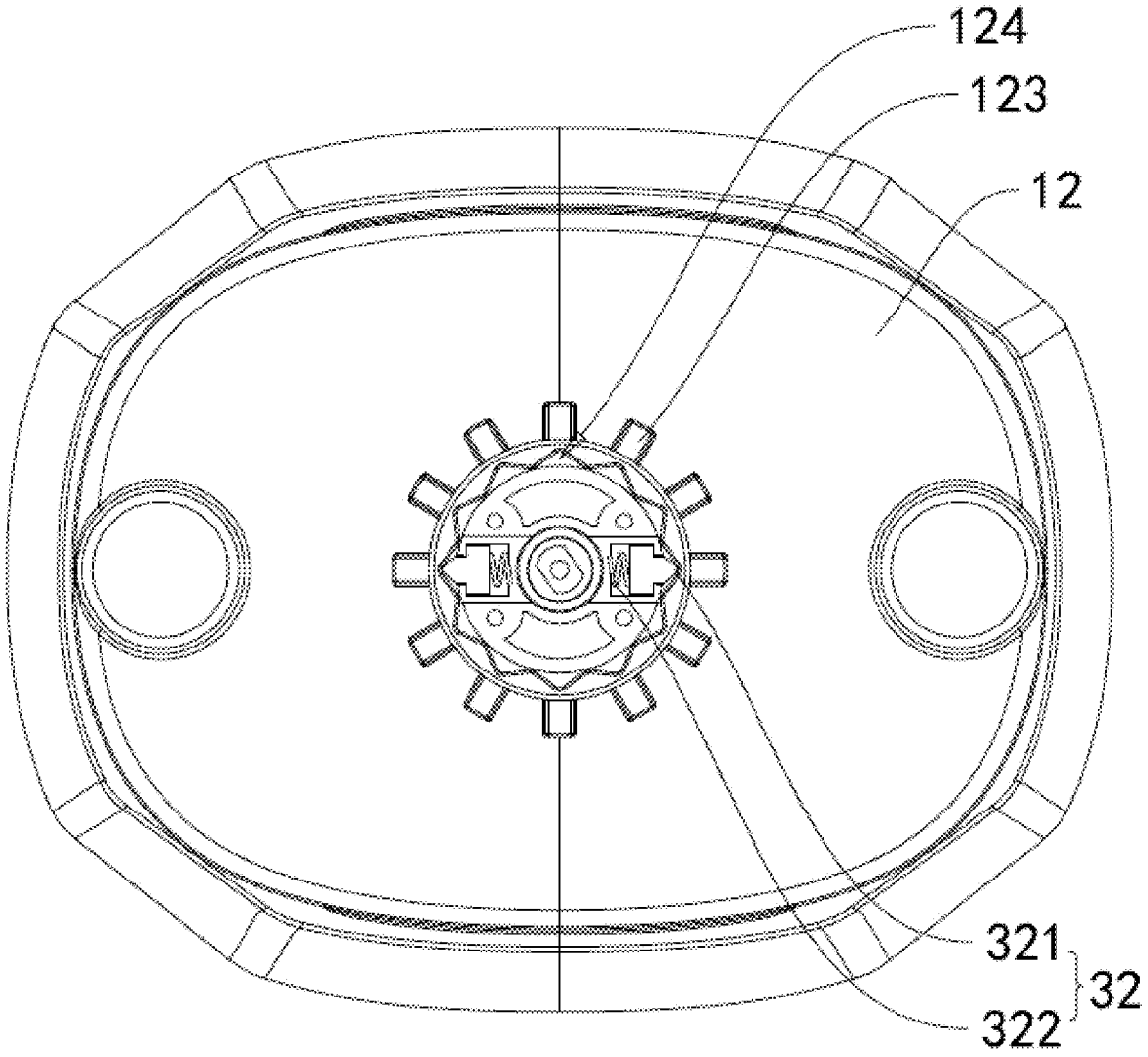
FIG. 15 is a schematic structural diagram of a shifting component for the adjustable kettlebell.
Figure 16:
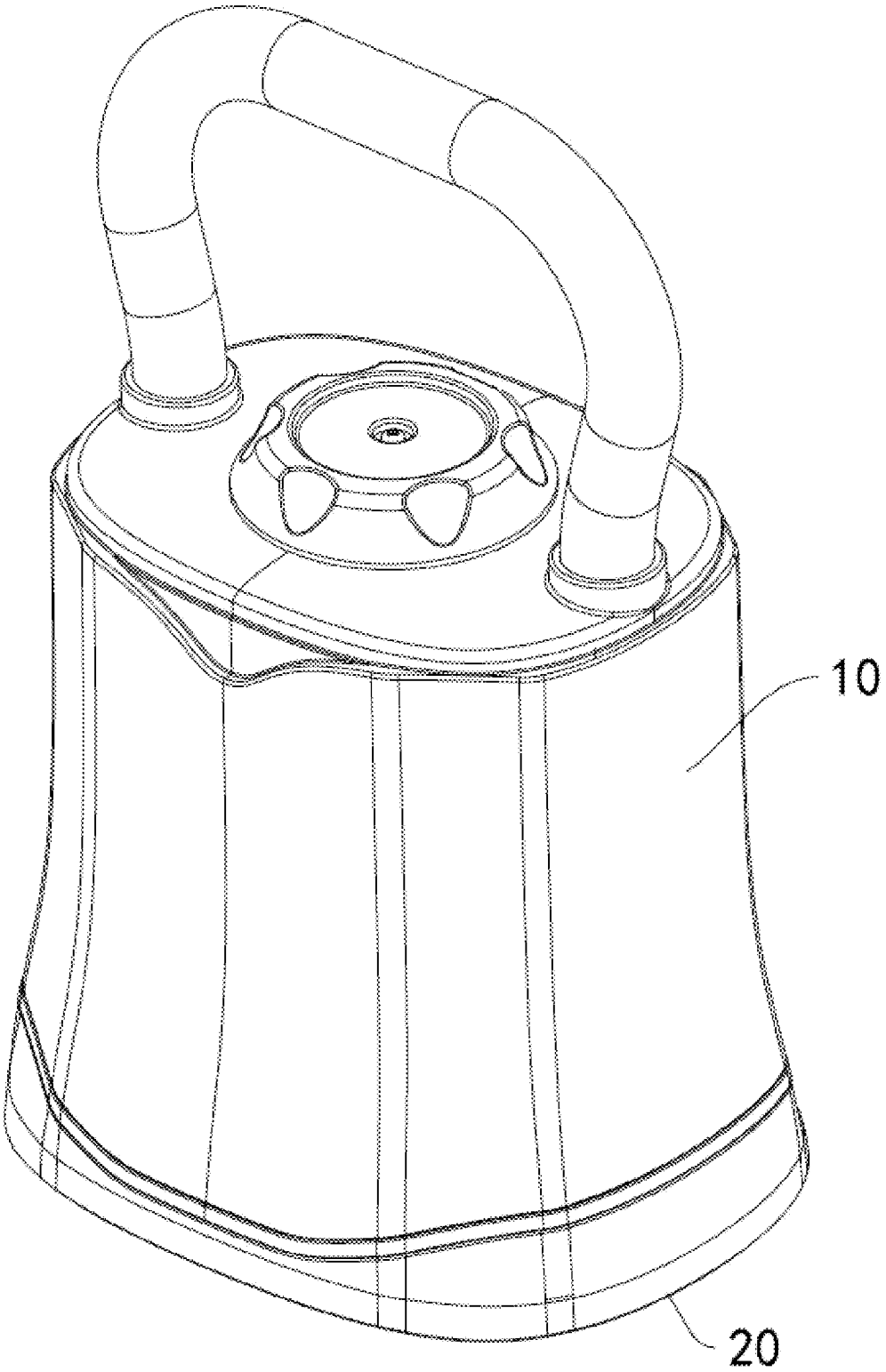
FIG. 16 is a first schematic diagram of an overall structure of a kettlebell kit.
Figure 17:
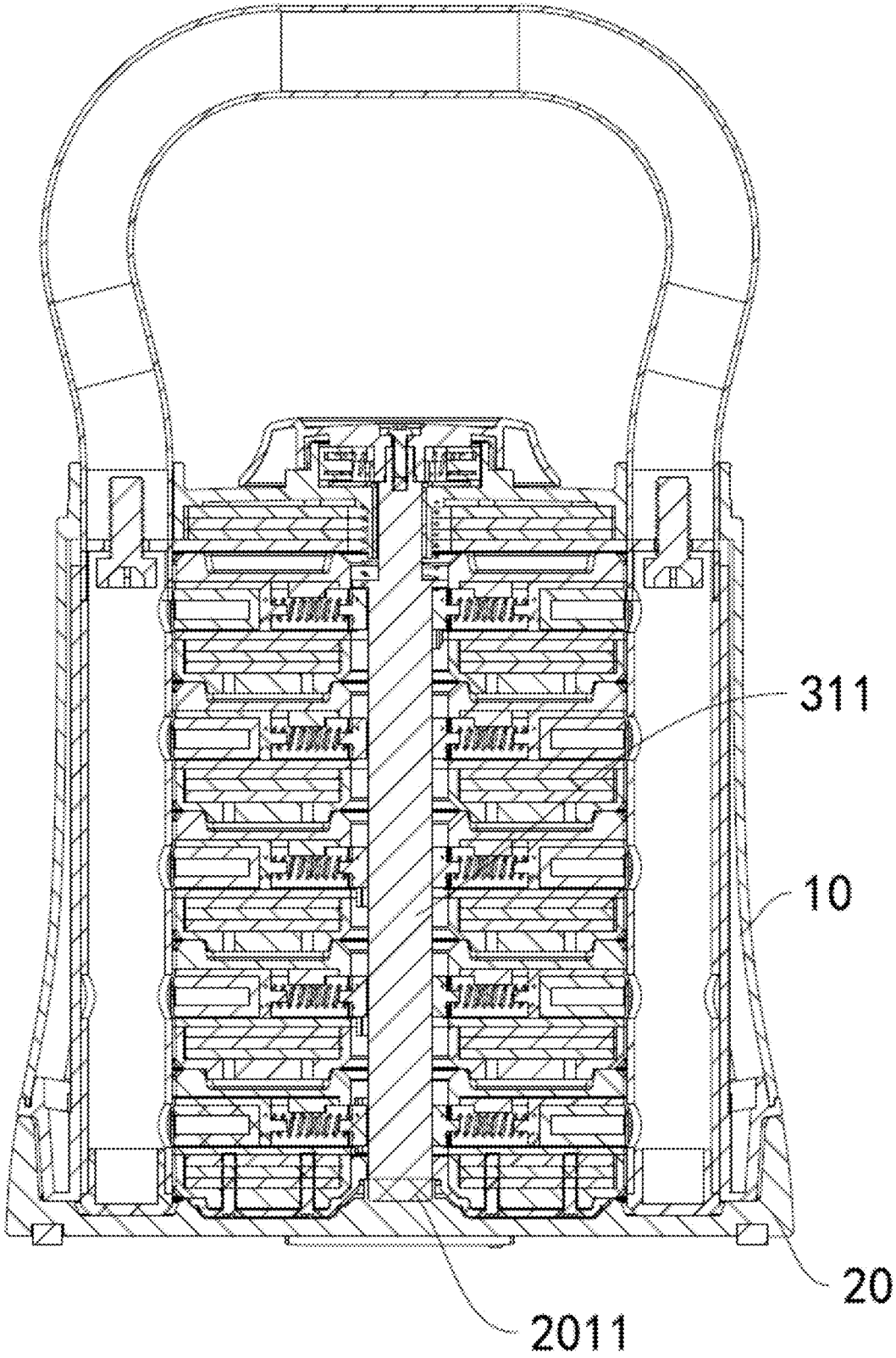
FIG. 17 is a sectional view of an overall structure of the kettlebell kit.
Figure 18:
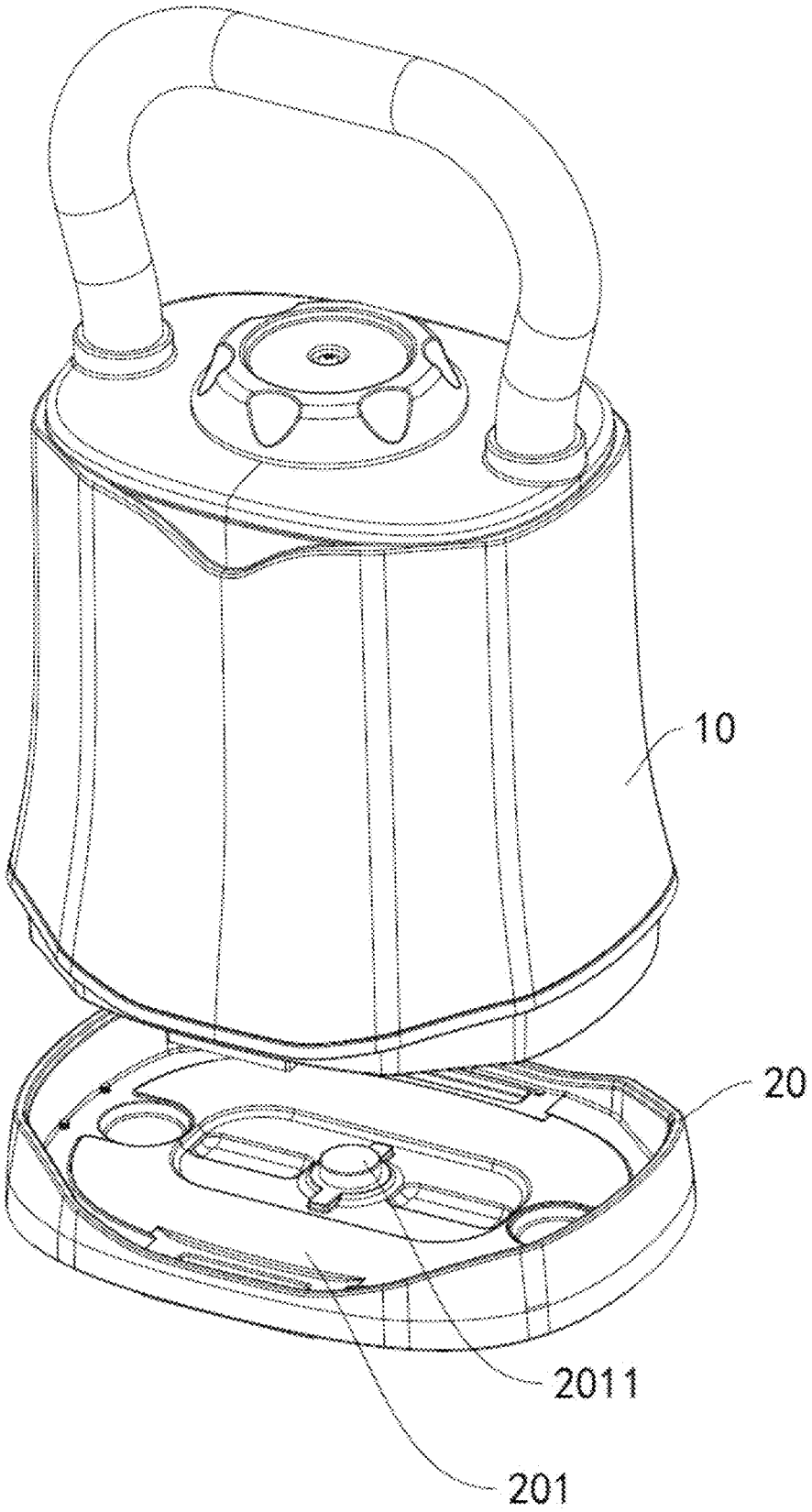
FIG. 18 is a second schematic diagram of an overall structure of the kettlebell kit.
Figure 19:
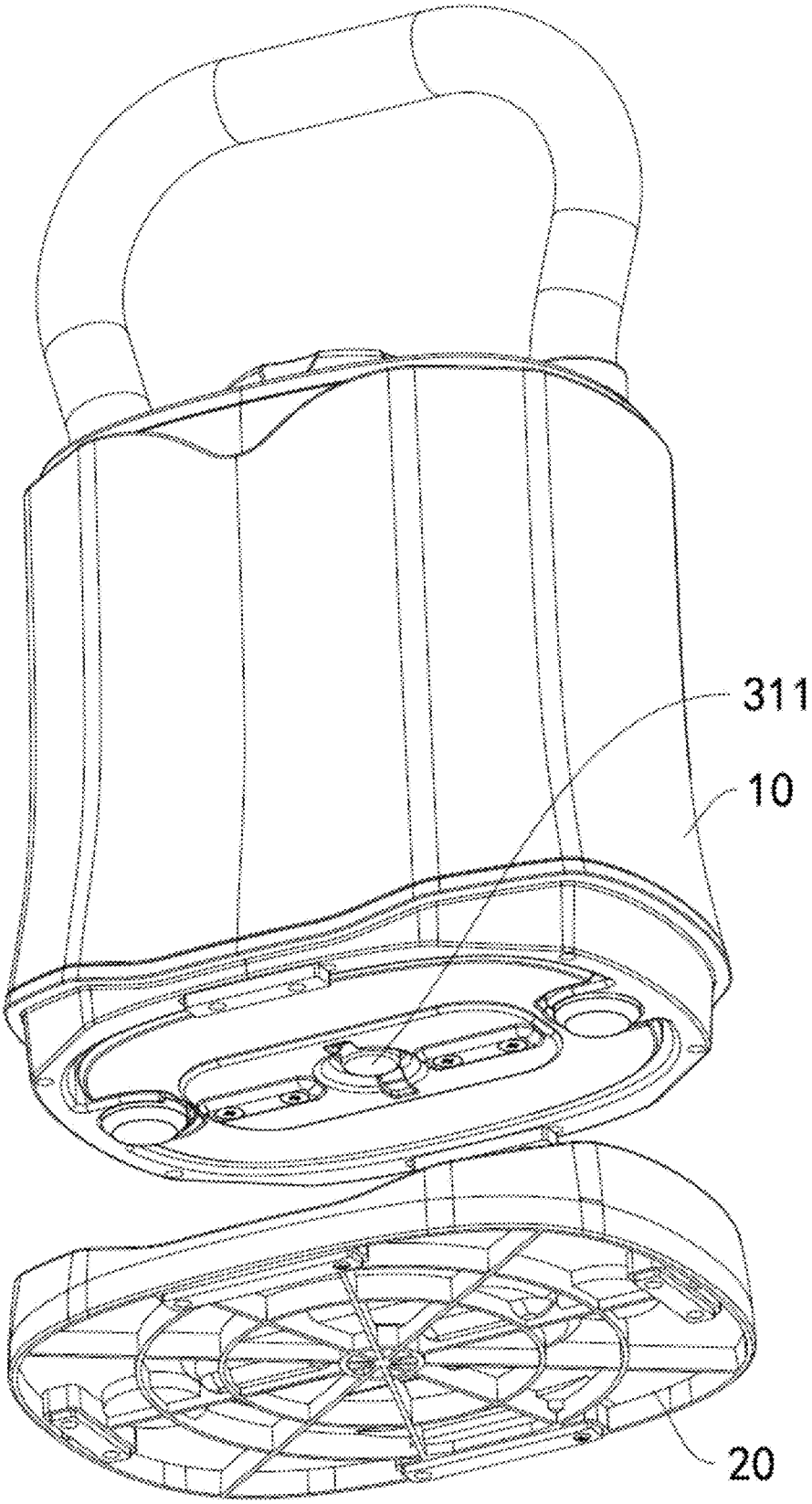
FIG. 19 is a third schematic diagram of an overall structure of the kettlebell kit.

Referring to FIGS. 11, 14, and 15, the driving mechanism 3 further includes two sets of shifting components 32, both of the two sets of shifting components 32 are provided on the driving cover 312. The two shifting components 32 are evenly distributed in the circumferential direction around an axis of the driving shaft 311. The shifting component 32 includes a shifting protrusion 321 and a shifting spring 322. The shifting protrusion 321 is slid in a radial direction to fit with the driving cover 312. The outer shell 12 is provided with a plurality of shifting slots 124, and the shifting slots 124 are evenly distributed in a circumferential direction around the central axis. The two shifting protrusions 321 are passed through any two shifting slots 124 that are directly faced. One ends of the two shifting springs 322 are connected to the driving cover 312, and the other ends of the two shifting springs 322 are respectively connected to the two shifting protrusions 321. When the driving cover 312 is rotated, the two shifting protrusions 321 is rotated along with the driving cover 312, the shifting protrusion 321 falls from the two opposing shift slots 124 into next two opposing shift slots 124, this forms the weight adjustment gear for adjusting the kettlebell, and emits a "click" sound to prompt the user that adjusting the weight of the kettlebell is in processed.

The implementation principle of the adjustable kettlebell in this application is as follows: when the user needs kettlebells of different weights to meet the needs of different exercise intensities, the driving shaft 311 drives the driving cover 312 to move away from the kettlebell shell 1, so that each of the locking protrusions 123 is respectively separated from each of the locking slots 3121. Then the user rotates the driving cover 312, and the driving cover 312 drives the driving shaft 311 to rotate, so that each of the driving protrusions 3111 sequentially pushes the corresponding adjustment component 25 of each of the kettlebell pieces 2 from a direction close to the kettlebell shell 1 towards a direction away from the kettlebell shell 1, so that the number of the adjustment component 25 corresponding to the weight of the kettlebell required by the user is connected to the kettlebell shell 1, thereby installing the corresponding number of kettlebell pieces 2 on the kettlebell shell 1. The kettlebell shell 1 adjusts the weight of the kettlebell to the weight required by the user. Thus, users only need to purchase one kettlebell to meet the needs of different exercise intensities, which improves the traditional kettlebells that are mostly fixed in weight. With the increase of exercise intensity, a plurality of kettlebells of different weights need to be purchased to meet the needs of different exercise intensities. This will increase economic investment and also occupy more space for placement or storage, which is extremely inconvenient.

As mentioned above, when the driving cover 312 can rotate around the central axis, each locking protrusion 123 needs to be disengaged from each of the locking slots 3121 and remain stable until the weight of the adjustable kettlebell 10 is adjusted.

Therefore, this embodiment further provides a kettlebell kit, referring to FIGS. 16 to 19. The kettlebell kit includes an adjustable kettlebell 10 and a kettlebell seat 20 configured to place the adjustable kettlebell 10. The kettlebell seat 20 is provided with a placement slot 201 configured to place the adjustable kettlebell 10, and an unlocking convex platform 2011 is fixedly provided in a middle of a slot body of the placement slot 201. When the adjustable kettlebell 10 is placed in the placement slot 201, the unlocking convex platform abuts against the driving shaft 311 and pushes the driving shaft 311 to slide in a direction close to the kettlebell shell 1 until the kettlebell shell 1 abuts against a slot body of the placement slot 201. When the driving shaft 311 is slid away from the kettlebell shell 1, it drives the driving cover 312 to slide away from the kettlebell shell 1, thereby rendering each locking protrusion 123 to disengaged from each of the locking slots 3121, allowing the driving cover 312 to rotate around the central axis, and the unlocking convex platform 2011 remains in contact with the driving shaft 311, each of the locking protrusions 123 is disengaged from each of the locking slots 3121 and remains stable. When a weight adjustment of the adjustable kettlebell 10 is completed, the adjustable kettlebell 10 is lifted, the driving shaft 311 is caused to be disengaged from the unlocking convex platform 2011. Then, the locking spring 313 pushes the driving shaft 311 to slide in a direction close to the kettlebell shell 1 until the driving shaft 311 is reset. When the driving shaft 311 is slid in a direction close to the kettlebell shell 1, it drives the driving cover 312 to slide in the direction close to the kettlebell shell 1, so that each of the locking protrusions 123 passes through each of the locking slots 3121, thereby allowing each of the locking protrusions 123 to re-limit the rotation of the driving cover 312, rendering it less likely for the weight of the adjustable kettlebell 10 to change when in use, thereby rendering the safety of the adjustable kettlebell 10 better.

The above are preferred embodiments of the present application and do not limit the protection scope of the present application. Therefore, any equivalent changes made according to the structure, shape, and principle of the present application should be included in the protection scope of the present application.

What is claimed is:

1. An adjustable kettlebell, comprising a kettlebell shell;

one or more kettlebell pieces, each of the one or more kettlebell pieces is provided with an adjustment component; when the adjustment component is connected to the kettlebell shell, the corresponding kettlebell piece of the adjustment component is provided on the kettlebell shell, wherein the adjustment component comprises two adjustment pin seats, two adjustment pin bodies, and two adjustment springs; and a driving mechanism, the driving mechanism is provided on the kettlebell shell, the driving mechanism comprises a driving component, and the driving component is configured to drive any number of the adjustment components to connect to the kettlebell shell; wherein the driving component comprises a driving shaft, a driving cover and a locking spring.

2. The adjustable kettlebell according to claim 1, wherein the two adjustment pin bodies slides radially to fit on the respective kettlebell piece; when the adjustment component is connected to the kettlebell shell, each of the two adjustment pin bodies is threaded through the kettlebell shell so that the respective kettlebell piece is provided on the kettlebell shell.

3. The adjustable kettlebell according to claim 2, wherein the driving shaft is provided on the kettlebell shell, an axis of the driving shaft is coaxial with a central axis;

the driving shaft is rotated around the central axis; the driving shaft is sequentially threaded through each of the one or more kettlebell pieces from close to the kettlebell shell towards away from the kettlebell shell;

the driving shaft is fixedly provided with one or more sets of driving protrusions, and there are one or more driving protrusions in each set of driving protrusions;

each set of driving protrusions corresponds to each of the one or more kettlebell pieces; when the driving shaft is rotated, any number of the one or more driving protrusions pushes a corresponding number of two adjustment pin bodies through the kettlebell shell.

4. The adjustable kettlebell according to claim 3, wherein the driving cover is coaxially fixed to the driving shaft, and the driving cover is rotated to drive the driving shaft to rotate.

5. The adjustable kettlebell according to claim 4, wherein the driving cover is provided with a plurality of locking slots, and the plurality of locking slots are distributed around an axis of the driving cover in a circumferential direction;

the kettlebell shell is fixedly provided with a plurality of locking protrusions, and when each of the plurality of locking protrusions passes through each of the plurality of locking slots, a rotation of the driving cover is blocked by each of the plurality of locking protrusions, so that each of the one or more kettlebell pieces is stably provided on the kettlebell shell.

6. The adjustable kettlebell according to claim 5, wherein one end of the locking spring abuts against the driving shaft, and the other end of the locking spring abuts against the kettlebell shell.

7. The adjustable kettlebell according to claim 4, wherein the driving mechanism further comprises one or more sets of shifting components, each of the one or more sets of shifting components is provided on the driving cover and distributed circumferentially around the axis of the driving shaft;

the one or more sets of shifting components comprise a shifting protrusion and a shifting spring; the shifting protrusion is slid radially and fitted with the driving cover; the kettlebell shell is provided with a plurality of shifting slots, and the shifting protrusion penetrates any shifting slot;

one end of the shifting spring is connected to the driving cover, and the other end of the shifting spring is connected to the shifting protrusion.

8. The adjustable kettlebell according to claim 3, wherein a curvature of each of the one or more driving protrusions is gradually decreased from a direction close to the kettlebell shell towards a direction away from the kettlebell shell, so that the driving shaft sequentially drives each of the adjustment components from a direction close to the kettlebell shell towards a direction away from the kettlebell shell.

9. The adjustable kettlebell according to claim 2, wherein one end of the adjustment spring abuts against the two adjustment pin bodies, and the other end of the adjustment spring abuts against the one or more kettlebell pieces.

10. A kettlebell kit, comprising the adjustable kettlebell according to claim 1 and a kettlebell seat configured to place the adjustable kettlebell, the kettlebell seat is provided with a placement slot configured to place the adjustable kettlebell, and the placement slot is fixedly provided with an unlocking convex platform;

when the adjustable kettlebell is placed in the placement slot, the unlocking convex platform abuts against the driving shaft and pushes the driving shaft to slide in a direction close to the kettlebell shell.

* * * * *